United States Patent [19]

Gruenhagen

[11] 4,115,880

[45] Sep. 26, 1978

[54] FLUSH VALVE CONTROL ASSEMBLY

[76] Inventor: Henry William Gruenhagen, 2030 Ebers, San Diego, Calif. 92107

[21] Appl. No.: 824,528

[22] Filed: Aug. 15, 1977

[51] Int. Cl.[2] ..... E03D 1/34; E03D 1/14; E03D 3/12

[52] U.S. Cl. ..... 4/325; 4/326; 4/378

[58] Field of Search ..... 4/67 A, 1, 18, 34, 37, 4/57 P, 57 R, 325-327, 378

[56] References Cited

U.S. PATENT DOCUMENTS

| | | | |
|---|---|---|---|
| 2,690,567 | 10/1954 | Quebbeman | 4/67 A |
| 3,237,211 | 3/1966 | Brown | 4/67 A |
| 3,546,715 | 12/1970 | Wustner | 4/67 A |
| 4,000,526 | 1/1977 | Biela et al. | 4/57 P |

*Primary Examiner*—Richard E. Aegerter
*Assistant Examiner*—Willis Little
*Attorney, Agent, or Firm*—Brown & Martin

[57] ABSTRACT

A control system for a toilet flush valve includes an automatically controlled vent valve for controlling the venting of the flush valve to provide a long flush or a short flush controlled by a combination of the toilet flush handle and a float controlled latch within the tank.

9 Claims, 6 Drawing Figures

FLUSH VALVE CONTROL ASSEMBLY

BACKGROUND OF THE INVENTION

The present invention relates generally to flush toilets and pertains particularly to a water saving flush valve control system.

A critical shortage of fresh water exists throughout much of the world and many of the Western states of the United States. This shortage is due in part to drought conditions which have existed for some time and in part to expanding population and use of fresh water. Much of the water used is wasted because of wasteful practices and wasteful water using applicances.

One of the most wasteful appliances of the civilized world is the flush toilet. The average flush toilet uses between 5 and 7 gallons of fresh water per flush and is flushed as many as a half of a dozen times per individual per day. This comsumes or more particularly wastes, a considerable amount of water.

It is therefore desirable that some means be avilable to conserve water and yet provide an effective flush toilet.

SUMMARY AND OBJECTS OF THE INVENTION

It is therefore the primary object of the present invention to overcome the above problems of the prior art.

Another object of the present invention is to provide means for conserving water.

A further object of the present invention is to provide means for conserving water in a flush toilet.

A still further object of the present invention is to provide an effective and simple control means for permitting the use of a minimum amount of water for flushing a toilet.

In accordance with the primary aspect of the present invention a toilet flush valve is provided with vent control means for controlling the closing of the flush valve in response to a predetermined lever control depression for selectively obtaining a long or short flush of the toilet.

BRIEF DESCRIPTION OF THE DRAWINGS

The above and other objects and advantages of the present invention will become apparent from the following description when read in conjunction with the drawings, wherein.

DETAILED DESCRIPTION OF A PREFERRED EMBODIMENT

Figure 1:
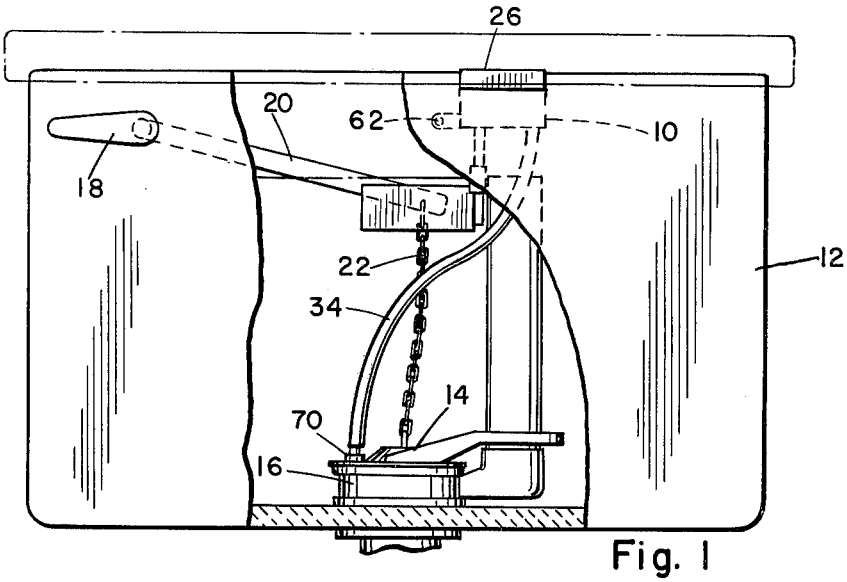
FIG. 1 is a front elevational view partially cut away, showing the flush control unit installed in a toilet tank.

Turning now to FIG. 1 of the drawing, there is illustrated a control valve assembly in accordance with the present invention, designated generally by the numeral 10, is shown mounted on the upper edge of a flush tank 12 for operation in conjunction with a flapper valve 14, normally seated in a valve seat 16 controlling the flow of water from the tank 12 into a toilet bowl for flushing purposes. The normal toilet flush assembly includes a handle 18 pivotally mounted in the wall of tank 12 and including an arm 20 secured thereto on the inside of the tank, and to which a chain 22 is connected for connecting to the flapper valve 14. the flapper valve 14 is of the conventional inner chamber type having a generally semi-spherical configuration, with a hollow interior opening into the drain pipe portion of the valve.

The valve control assembly 10 in accordance with the present invention is designed to operate in conjunction with and become responsive to both the flush lever or handle 18 and the level of water in the tank 12.

Figure 2:
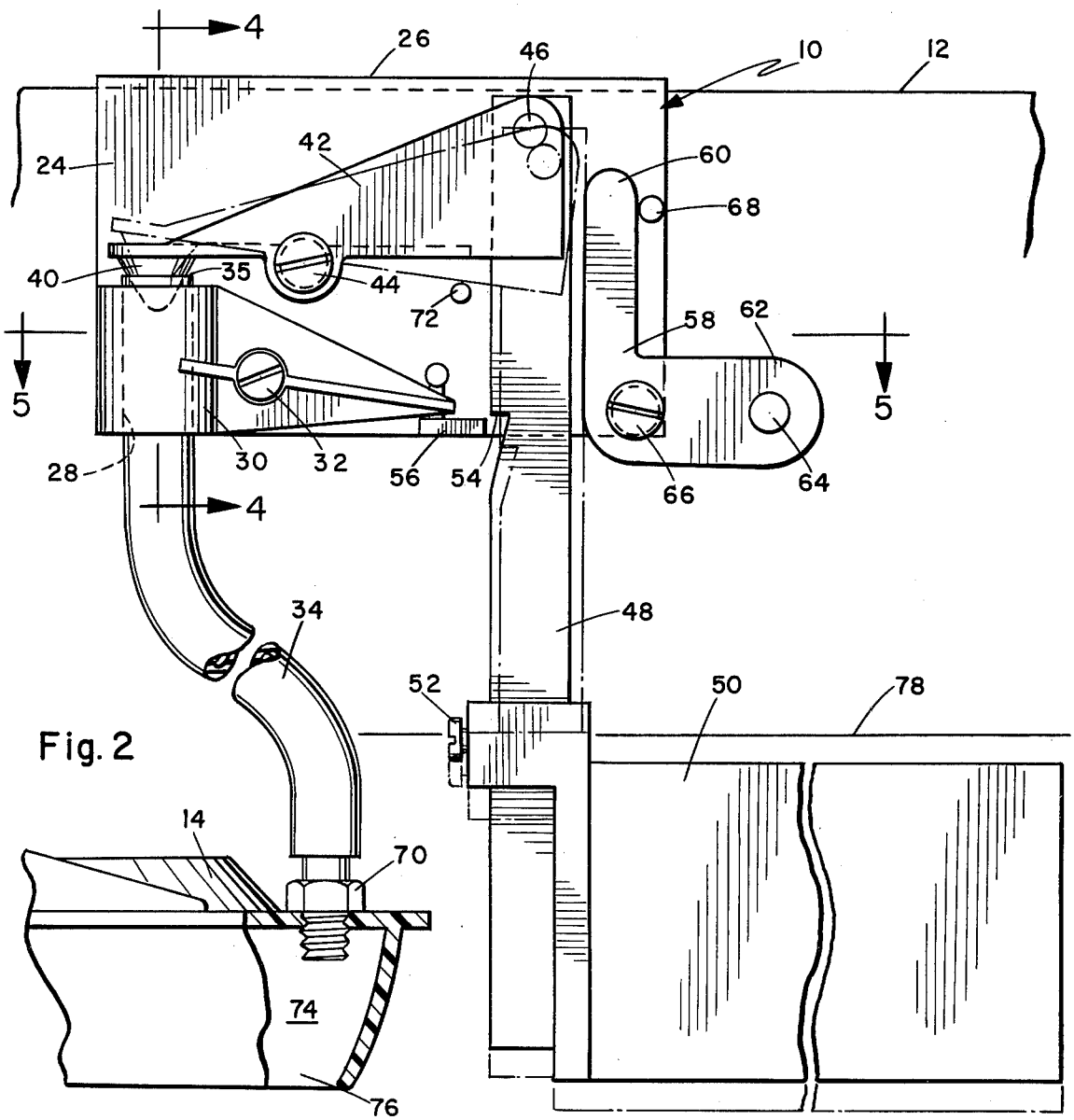
FIG. 2 is an enlarged rear elevational view of the flush control unit, showing the short flush action.
Figure 3:
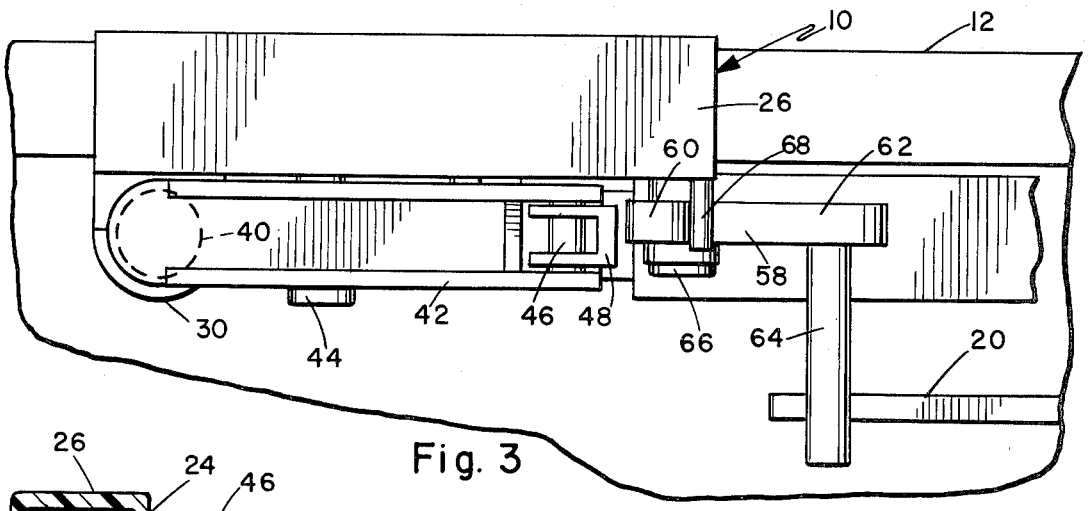
FIG. 3 is a top plan view of the flush control unit.
Figure 4:
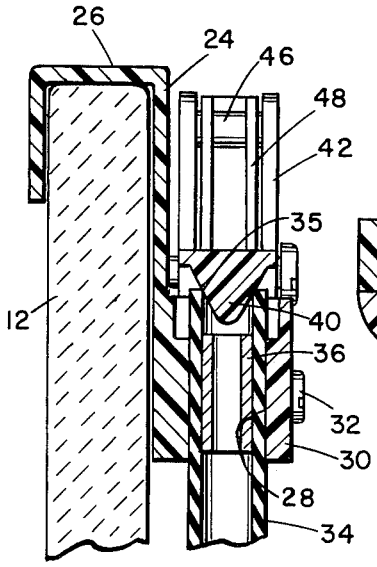
FIG. 4 is a sectional view taken on line 4—4 of FIG. 2.
Figure 5:
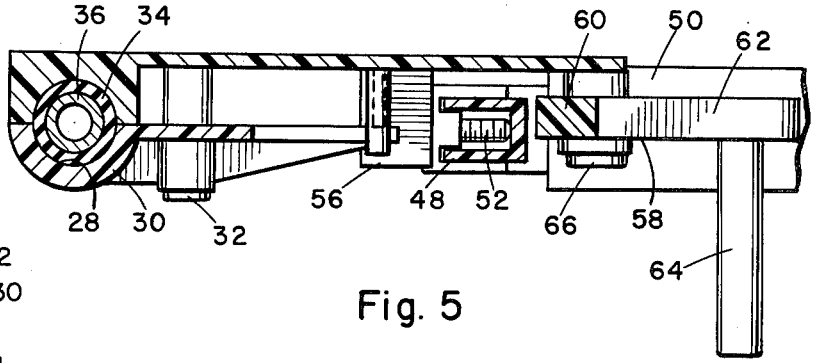
FIG. 5 is a sectional view taken on line 5—5 of FIG. 2.

As best seen in FIGS. 2 through 5, the valve control assembly in accordance with the invention comprises a base or bracket member 24 having a generally U-shaped bracket portion 26 for extending over the upper edge of the wall of the tank 12 for mounting the bracket beneath the lid of the tank. The valve assembly bracket simply hooks over the upper edge of the wall, as best seen in FIG. 3, and the cover of the tank rests on the bracket holding it in place. The control assembly includes a valve body defined by a cylindrical bore 28 defined by a semicircular portion of the bracket member 24 and a clamp member 30. The clamp member 30 is secured in place by suitable means, such as a screw 32. The valve bore may be further defined by a flexible tube 34 having a tubular metal or rigid insert 36 as shown in FIG. 4 The upper end of the tube 34 extends beyond the upper edge of the bracket and valve housing defining a valve seat 35 which, because of its resilience provides good seating and sealing. A vent plug or valve member 40 is pivotally mounted on the base or bracket member 24 by means of a rocker arm 42 which is pivotally mounted by a suitable screw 44 to the bracket 24. The rocker arm 42 is in the form of a lever having a pivotal pin 46 on the opposite end thereof from the valve member 40, to hold the upper end of a float rod 48.

An adjustable float 50 constructed of a suitable light weight floating material is adjustably secured to the lower end of the float rod 48 and is adjustably attached thereto by suitable means such as a screw 52. With this arrangement, the float 50 may be adjustably positioned along the length of the float rod 48. The center of gravity and buoyancy of float 50 is offset to one side of the pivot axis 46.

The apparatus includes a latching mechanism for latching the valve in the closed position for certain circumstances. This latch mechanism comprises a latch notch 54 formed in the float rod 48 for engaging a latch bar 56 secured to and made integral with and extending outward from the bracket 24.

The latch operating mechanisms comprises a bell crank 58 having a first arm 60 for engaging the float rod 48 between the pivot pin 46 and the notch 54, forcing the float rod 48 to the left into engagement with the notch bar or latch bar 56. An arm 62 of the bell crank includes a pin 64 for engagement by the arm 20 of the convenional flush control of the toilet. The bell crank is pivotally mounted by suitable pin, such as a screw 66, to the bracket or base member 24. A stop member 68 prevents the bell crank from pivoting downward and away from its operating position.

The flexible vent tube 34 is secured at the upper end thereof in the clamp body member and at the lower end to a suitable fitting 70 for connecting the lower end thereof to the ball or flapper valve of the flush tank. The flush valve 70 as illustrated in of the flapper type having an inner air chamber 74 and a lower opening 76 into the air chamber 74. The air chamber communicates with the drain line from the tank into the bowl. The outer walls of the flapper valve seat against the valve seat in the flush assembly.

Figure 6:
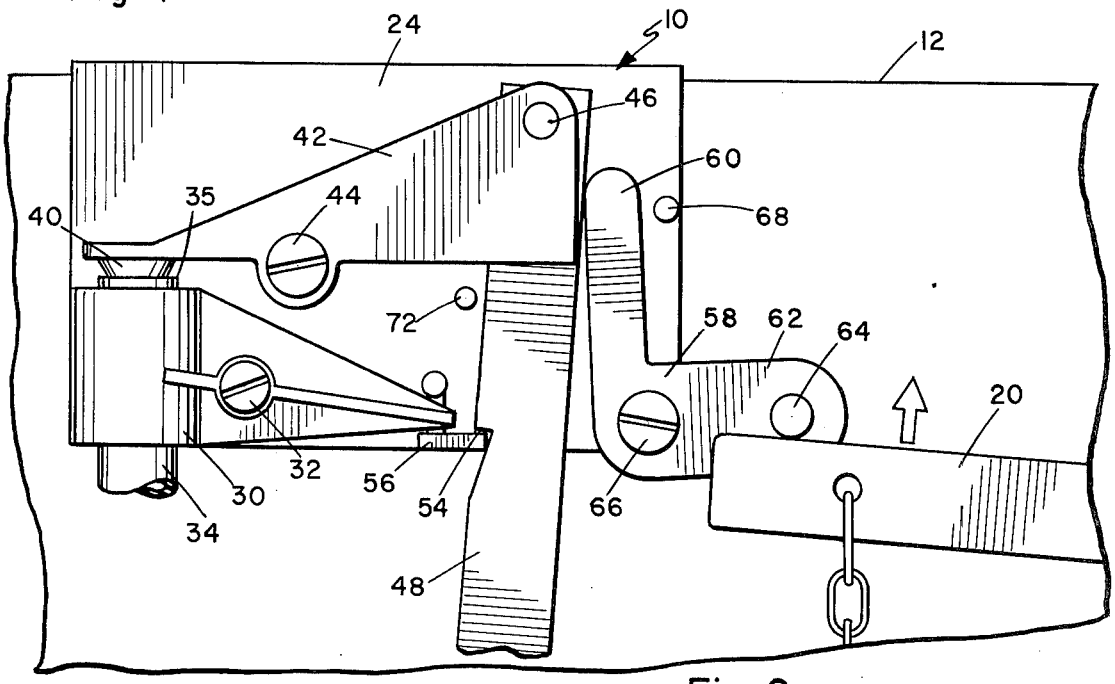
FIG. 6 is a view similar to a portion of FIG. 2, but showing the full flush action.

Installation of the present system as illustrated is such that the bracket or base member 24 is positioned such that the pin 64 of the bell crank 58 will be engaged by the outermost end of the acutating arm 20 of the flush handle 18. As best seen in FIG. 6, the flush handle and the flush control apparatus of the present invention are preferably adjusted such that the outer end of the flush arm 24 engages the pin 64 of the bell crank 58 near the uppermost end of its travel. The flush arm 20 engages the pin 64, pivoting the bell crank in counter clockwise direction into engagement with the float rod 48, forcing the latch notch 54 into latching position or engagement with the latch bar 56. In this position the valve 40 is seated into the valve seat 35, maintaining the valve in a closed or non-vented position. This maintains a seal of the chamber 74 such that the flapper valve will float when pulled away from its seat, thus, as long as the valve 40 is maintained in its seated position the flapper valve, once pulled away from its seat, will float and keep the flapper valve open until the tank 12 has been fully drained, so that the valve 14 is either pulled into the seated position or the flow or level of water drops below the opening 76 thereof to vent the valve, forcing it back into its seated position.

By the present invention, the venting of the chamber 74 of the flapper valve 14 is selectively controlled by the flush handle 18. With the apparatus installed in position, the water level 78 will be above the float 50, such that the valve 40 will be closed and the float rod 48 will be in a position to be latched by the bell crank 58 upon flushing the tank.

OPERATION

In operating the apparatus of the present invention, when installed as above described, the flushing cycle is controlled by the length of time that the flush handle 18 is held down. For example, for a short flush the handle 18 is pulled downward until the flapper valve 14 is unseated and arm 20 engages the pin 64 pivoting the rod 48 into latch position. However, upon releasing of the flush handle 18 prior to the water level 78 dropping below the float 50, the force of the water acting on the float will tilt the float and float arm in a counter clockwise direction out of the latched position, such that as the water drops the float will pull the float rod 48 downward, thus moving the rocker arm 42 and the valve 40 out of its seat. This immediately vents the chamber 74 of the flapper valve 14 causing it to fall into the closed position. Water then refils the tank 12 and as the water rises in the tank, the float 50 pushes the rocker arm 42 upward in a counter clockwise direction, again seating the valve 40.

In order to obtain a full flush, the flush handle 18 is held downward with the latch in the latch position, as shown in FIG. 6, until the water level 78 drops below the float 50. Once the water level drops below the float 50, the weight of the float and its offset center of gravity, as seen in FIG. 2, will tend to maintain the latch in its latched position, as seen in FIG. 6, preventing the venting of the flapper valve 14. The flapper valve 14 will then stay open until the tank is fully emptied. At this time the flapper valve will close and the normal control mechanism of the tank wll refill the tank until the latch control float moves the latch from its latch position and simultaneously seats the valve member 40 in readiness for the next cycle.

Thus, it will be seen that the latch will function to maintain the valve 40 seated for a long flush and the float 50 functions to pull the valve 40 open for the short flush with the latch in the unlatched position. It will be appreciated that the off center position of the float 50 functions to tilt the float or pull the float in a counter clockwise position in response to a water acting thereon for raising it and will tend to pull the arm 48 in a clockwise position in response to a lack of water thereon. In other words the offset weight of the float 50 will pull the arm 48 in a clockwise position about pivot 46 and maintain it in a latched position.

An additional stop member 72 is positioned to stop the pivotal movement of rocker arm 42 downward under the weight of float 50. The length of arm 60 and the pivot point 66 of the bellcrank 58 are such that the upper end of arm 60 will engage float rod 48 below pivot 46 in order to insure pivoting of rod 48 into latching engagement at 54 with 56. The pressure point (i.e. line of force) of arm 60 on rod 48 must also be between pivot 46 and fixed pivot 44 in order to pivot the rocker arm 42 counterclockwise such that valve 40 seats.

While the present invention has been described and illustrated by means of a specific embodiment, it is to be understood that numerous changes and modifications may be made in the apparatus without departing from the spirit and scope of the invention as defined in the appended claims.

Having described my invention, I now claim:

1. Vent control assembly for a flapper type flush valve comprising:

a valve body having a bore, tubular means connected to said valve body for communicating said bore with the air chamber of a flush valve, a valve member mounted on said body and comprising a rocker arm having a valve plug on one end for engaging said valve bore and selectively movable into and out of engagement with said valve bore for either selectively closing or venting said air chamber, and a float assembly connected to the other end of said rocker arm and responsive to the level of water acting thereon for controlling said valve member.

2. The vent control assembly of claim 1, including latch means for latching said valve in a closed position.

3. The vent control assembly of claim 2, wherein said latch means is responsive to said float to maintain a latched condition when water is below said float and responsive to water acting on said float for unlatching said valve.

4. The vent control assembly of claim 2, including latch means for latching said vent valve in a closed position, said latch means including means responsive to the toilet flush arm for biasing said latch means into a latched position.

5. The vent control assembly of claim 4, wherein said float assembly comprises an elongated rod pivotally connected at its upper end to said rocker arm and supporting said float at its lower end, and said latch means comprises a notch in said rod, and a fixed latch bar for engaging said notch 6. The vent control assembly of claim 5, wherein said valve body comprises a support bracket for mounting inside and near the upper edge of a flush tank, and said rocker arm is pivotally mounted on said bracket.

7. The vent control valve of claim 6, wherein said bracket is of a generally rectangular configuration having top, side and bottom edges and a genrally U-shaped supporting member at the upper edge for hooking over the upper edge of the wall of a tank, said valve bore is disposed adjacent one side edge and oriented vertically, and said means responsive to a toilet flush arm comprises a bell crank pivotally mounted adjacent the other side edge having one arm for engagement by a toilet flush arm for moving said float rod into latching engagement with said latch bar.

8. The vent control valve of claim 7, wherein said valve bore is defined by a clamp having an annular gripping surface and an end of a flexible tube disposed in said clamp and defining an annular valve seat.

9. The vent control assembly of claim 8, wherein said float is adjustably secured to said float rod for adjustment vertically along said rod, and said float is disposed on one side of said float rod for tilting said rod away from said latch bar in response to the buoyant forces of water acting thereon when the water level is above said float and for tilting said rod toward said latch bar position under the weight of said float when the water level is below said float.

* * * * *